US005645330A

United States Patent [19]

Artwohl et al.

[11] Patent Number: 5,645,330

[45] Date of Patent: Jul. 8, 1997

[54] REFRIGERATED DISPLAY CABINETS WITH IMPROVED MULLION ASSEMBLY

[75] Inventors: Paul J. Artwohl, Flossmoor; Melvin Kaspar, La Grange Park, both of Ill.; Richard A. Mamelson, Crown Point, Ind.

[73] Assignee: Ardco Incorporated, Chicago, Ill.

[21] Appl. No.: 719,087

[22] Filed: Sep. 19, 1996

[51] Int. Cl.[6] ..... A47F 3/04; F21V 5/02

[52] U.S. Cl. ..... 312/116; 312/138.1; 312/401; 312/405; 49/70; 49/504; 362/92; 362/125; 62/264

[58] Field of Search ..... 312/116, 401, 312/405, 406, 407, 407.1, 138.1, 296; 49/70, 504; 362/92, 125; 62/264

[56] References Cited

U.S. PATENT DOCUMENTS

| | | | |
|---|---|---|---|
| 2,995,649 | 8/1961 | Cyrus | 362/92 |
| 3,499,245 | 3/1970 | Winslor et al. | 49/504 X |
| 3,612,821 | 10/1971 | Stromquist | 49/70 X |
| 4,248,489 | 2/1981 | Barroero et al. | 49/70 X |
| 5,016,146 | 5/1991 | Kaspar | 362/92 |
| 5,070,650 | 12/1991 | Anderson | 49/504 X |
| 5,374,116 | 12/1994 | Borgen et al. | 312/116 |
| 5,471,372 | 11/1995 | Mamelson et al. | 362/92 |
| 5,544,454 | 8/1996 | Richardson et al. | 312/116 X |

*Primary Examiner*—Peter M. Cuomo
*Assistant Examiner*—James O. Hansen
*Attorney, Agent, or Firm*—Marshall W. Sutker; Laff, Whitesel, Conte & Saret, Ltd.

[57] ABSTRACT

A commercial refrigerated display case includes mullions for slideably receiving removable ballast drawers from the sides of the mullions for quickly and easily servicing fluorescent ballasts.

3 Claims, 4 Drawing Sheets

REFRIGERATED DISPLAY CABINETS WITH IMPROVED MULLION ASSEMBLY

TECHNICAL FIELD

The present invention relates generally to commercial refrigerator door frame assemblies and more particularly to a mullion used in such door frame assemblies.

BACKGROUND OF THE INVENTION

A wide variety of commercial refrigerator display cabinets exist. One very common type of such a cabinet utilizes a series or array of hinged glass panel refrigerator doors. Glass panel refrigerator door arrays are widely used in a variety of commercial installations, such as those from which purchasers may select refrigerated or frozen food products or beverages.

Typical commercial refrigerator display cabinets, such as those used in supermarkets, include a cabinet frame which extends generally about the periphery of the front of the display cabinet. The frame includes a top or upper frame member, a bottom or lower frame member, and suitably laterally spaced side frame members extending vertically between the top and bottom frame members. The frame members are adapted to be arranged in a rectangular configuration with the respective end portions of the frame members forming 90 degree angles in each of the corners of the frame. Such frames also include one or more columns or mullions which extend vertically between the top frame member and the bottom frame member and are connected thereto. The mullions not only provide rigidification for the cabinet frame and structural support for the associated doors, but also define sealing surfaces against which portions of the door assemblies engage and seal for effective sealing of the refrigerated cabinet. The mullions may also be equipped with electrical conduits for delivering electrical power, such as to anti-condensation devices for the door assemblies. Mullions may also serve to mount fluorescent light fixtures.

The mullions in refrigerated cabinet door arrays are also frequently used to mount and house fluorescent light ballasts. Access to such ballasts is required from time to time for service and replacement. Conventional systems for mounting such ballasts on or internally of mullions make it difficult and time-consuming to gain access to the ballasts and to service and replace them.

Because time is of the essence in the service and replacement of ballasts, in part because such service and replacement occurs with a door to the cabinet open, in an environment in which the temperature should be kept at temperature of just above freezing in the case of a refrigerator, and well below freezing in the case of a freezer, the ballast mounting systems currently available and in use leave a great deal to be desired.

In many refrigerator and freezer cabinet frame assemblies, the doors in a series are all mounted on associated frames and mullions so that they may be opened from the same direction. As such, they are all similarly mounted, say on hinge pins on the left, with handles on the right. Thus, each mullion has a hinge axis at its front. To gain access to the interior of the mullion from the front requires removal of the door. Further, because of the use and location of anti-condensation heater wires in many cabinet arrays (the wires of which are usually positioned internally of the mullion at the front, both for access and so that they are located where they are most functional), front access to ballasts positioned internally of mullions require removal of the heater wires. This is also highly undesirable.

Mounting of the ballasts at the rear of the mullion also makes it very difficult to gain access for service and replacement. Considering that servicing of ballasts usually occurs while the refrigerator or freezer unit is in operation, and that the shelves in the freezer or refrigerator impede access to the rear of the mullion, it will be clear that shelving and possibly even doors must be removed when removing and securing ballasts which are mounted at the rear of mullions. Finally, fluorescent lights themselves are typically mounted on the rear surfaces of mullions. In such situations, if ballasts are to be removed from or through the rear of a mullion, the fluorescent fixtures must also be removed.

It would be desirable to provide refrigeration cabinet door and frame arrays having mullions from which ballasts can be quickly removed, and while the associated refrigerator or freezer remains in service.

SUMMARY OF THE INVENTION

In accordance with the present invention, an improved refrigerated cabinet assembly having a perimetric frame and a plurality of elongated vertical mullions spaced along the length of the cabinet assembly is provided. Each mullion is secured at its top and its bottom to the perimetric frame, and a series of rectangular doors are mounted on the frame for swinging movement on vertical hinge axes between open positions and closed positions. Each mullion is generally rectangular and hollow and has a front surface facing outwardly of the cabinet assembly, a back surface facing inwardly of the cabinet assembly, and a pair of side walls. The rectangular doors define surfaces confronting the front surfaces of the mullions and are adapted to seal therewith. One of the side walls of each mullion define an access opening. A ballast assembly is provided. The ballast assembly comprises a ballast drawer, a fluorescent ballast removably secured thereto, and means for removeably securing the ballast assembly to a mullion, the ballast drawer being adapted for sliding insertion into the mullion access opening and for withdrawal therefrom, whereby the fluorescent ballast may be quickly and easily removed for service by withdrawing the drawer from the mullion and may be quickly and easily reinstalled by slidingly inserting the ballast into the mullion from the side thereof.

In a preferred form the ballast drawer comprises a ballast support plate and a mounting plate providing the means for securing the said ballast assembly to the mullion. Desirably the mullion comprises a hollow structural member and a sheath, and the access opening comprises openings defined by each of the member and the sheath.

Further objects, features and advantages of the present invention will become apparent from the following description and drawings.

DETAILED DESCRIPTION

Figure 1:
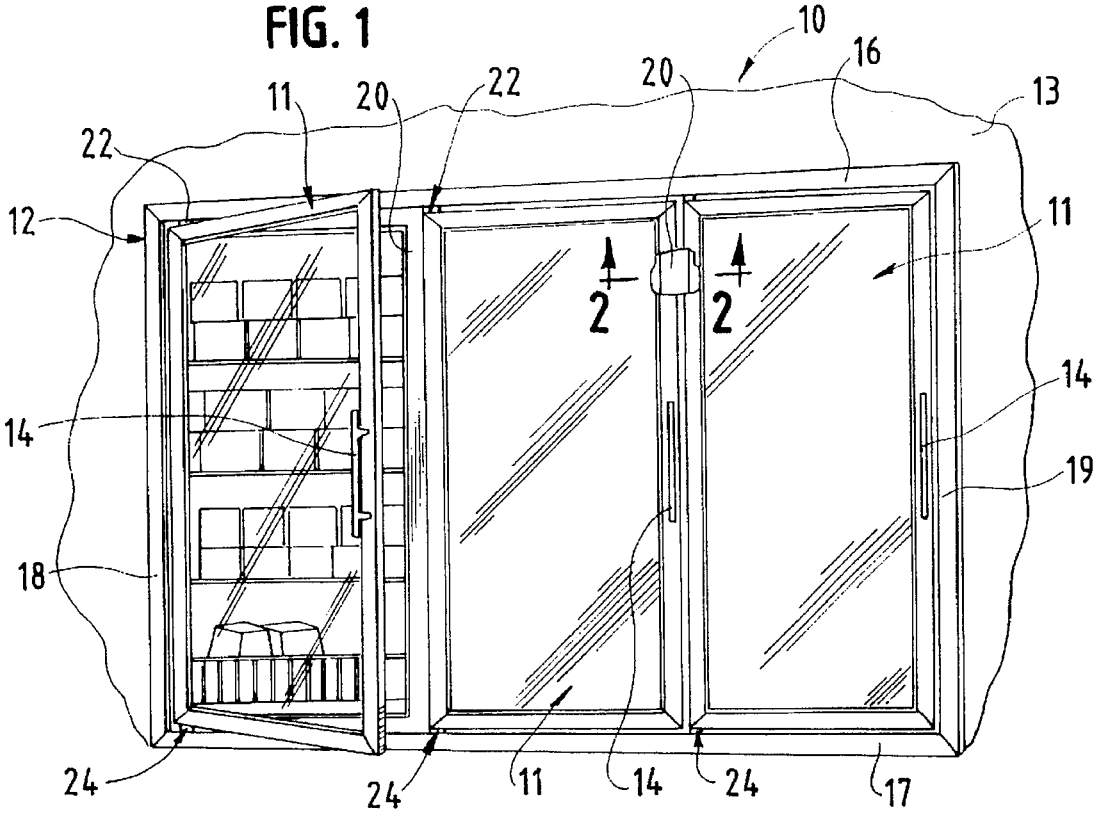
FIG. 1 is a front perspective view of a refrigerated display cabinet incorporating an improved mullion assembly of the present invention.

Referring now to the drawings, FIG. 1 shows an illustrative refrigerated cabinet assembly 10 comprising an arrayed plurality of glass doors 11 mounted for swinging movement in a door mounting cabinet perimetric frame 12. Frame 12 is mounted within an opening in a front wall 13 in which a refrigerator cabinet or the like is recessed. It will be understood that the cabinet assembly 10 is particularly adapted for use as a free standing refrigerator or freezer case or as a built-in cooler or cabinet of the type used in supermarkets and other retail stores to display refrigerated or frozen merchandise.

The frame 12 extends about the periphery of the opening in the wall 13 and includes a plurality of elongated vertical mullions 20 that extend vertically between the top and bottom frame members and which are spaced along the length of the cabinet assembly. As is conventional, the mullions 20 provide rigidity for the frame 12 and define front surfaces against which the free, swinging confronting surfaces of the doors 11 engage and seal in a conventional manner when in a closed position. The doors 11 are typically rectangular, are of any suitable construction, and may comprise glass panels bordered by metal trim. Each door 11 is hingedly mounted on a vertical hinge axis for swinging movement between open and closed positions and each door has a handle 14 for facilitating access to the interior of the cabinet 10, both for stocking by store personnel and for selection of the contents by customers. The doors are typically upper and lower hinge pins 22, 24 which are mountable on the frame assembly in a known manner.

The cabinet frame 12 includes a plurality of frame members, preferably in the form of extrusions made of aluminum or other suitable material, arranged in a rectangular configuration about the periphery of the cabinet opening. The frame members may include top and bottom frame members 16, 17 and side frame members 18, 19. They may be of any suitable known construction and may be hollow so as to define one or more channels which are adapted to receive electrical heating cables for maintaining the extrusions at temperatures sufficient to avoid a build-up of condensation. The frame members are secured at their respective ends to form an integrated frame assembly consistent with prior art practices.

Each mullion 20 is generally rectangular and hollow and typically comprises a first metallic hollow structural mullion member 40, such as an aluminum extrusion. Extension 40 may be generally U-shaped in configuration and comprises a base 42 and a pair of legs 44 which are perpendicular to the base 42. Base 42 has outwardly projecting extensions 43 which serve both a rigidifying function and a mounting function. The legs 44 define elongated ribs 46 which serve to strengthen and rigidify the legs 44 and which may serve to support other portions of the mullion. In the embodiment illustrated, an insulating support plate 48 for mounting condensation preventing heating wires may be positioned against ribs 46 on opposed legs 44. Support plate 48 may be any suitable insulating material, of which polyvinyl chloride is one such suitable material.

Figure 2:
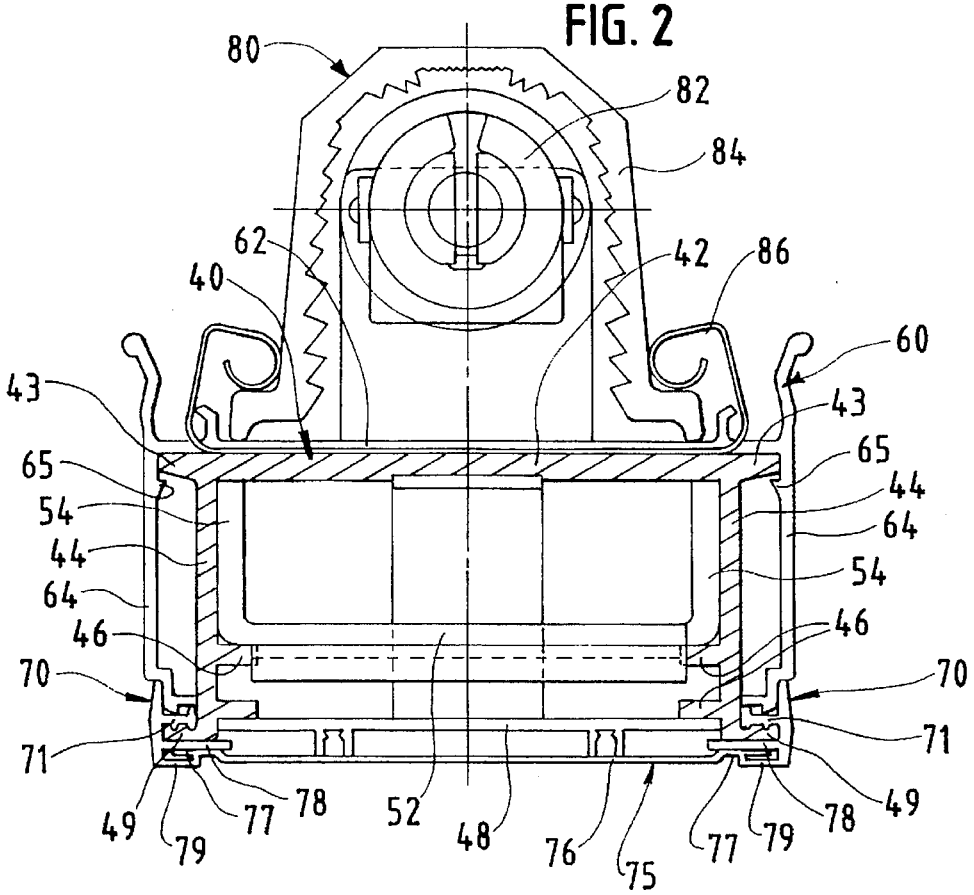
FIG. 2 is a cross-sectional view of a mullion assembly of FIG. 1 taken substantially along line 2—2 of FIG. 1.
Figure 3:
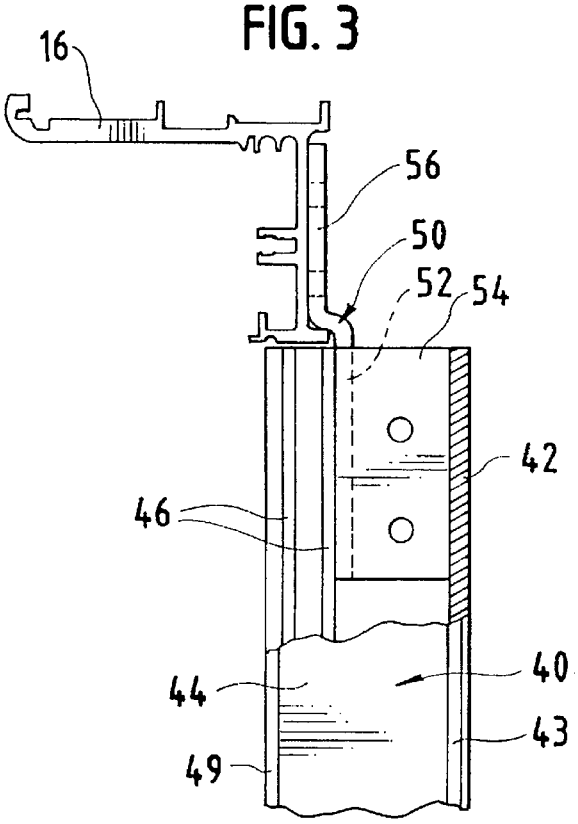
FIG. 3 is a fragmentary view of the mullion assembly of FIGS. 1 and 2 as mounted to the top frame member of the cabinet/of FIG. 1.

As stated above, the mullions 20 are mounted to the frame assembly 10. To that end suitable clips 50 (see FIG. 3) are provided for threaded securance to the structural member 40 and to the upper frame member 16 and similarly to the lower frame member (not shown). Clips 50 comprise a web 52, side legs 54 for securance via fasteners to the mullion member 40 and a plate 56 for securance to the frame member 16, as best seen in FIGS. 2 and 3. Suitable screws or other fasteners, not shown, may be used to connect the clips 50 to the frame member 16, as in the zones illustrated in FIG. 3.

Figure 9:
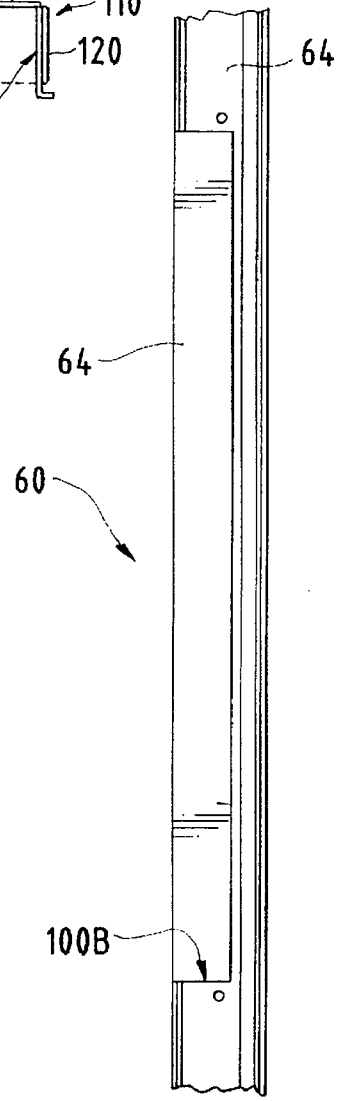
FIG. 9 is side elevational view of a second mullion member.
Figure 10:
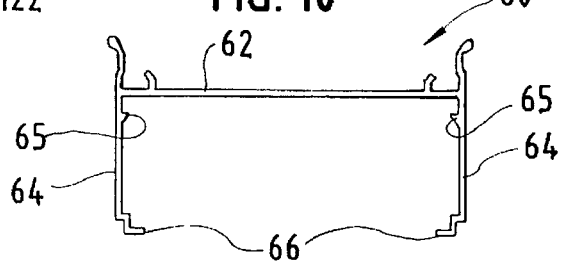
FIG. 10 is an end view of the second mullion member of FIG. 8.

Mullion 20 also includes a mullion sheath 60 (see FIGS. 2, 9 and 10). Sheath 60 may be of a suitable plastic, such as polyvinyl chloride, and, as best seen in FIG. 2, is snap-connected to mullion member 40. Sheath 60 includes a vertical web 62 and legs 64 which project forwardly from the web 62. Ribs 65 are positioned on legs 64 so that they and the web 62 grip the base extensions 43 to snap-lock the mullion member 40 and sheath 60 together. At their forward edges, legs 44 of the mullion member 40 and the forward edges 66 of the legs 64 are held together by vertical trim strips 70. Trim strips 70 are secured via outwardly projecting ribs 49 formed on the mullion member 40.

The mullion assembly 20 is closed at its front by a cover plate 75. Cover plate 75 comprises a front panel 76 and has a pair of offset edges 77. Edges 77 are retained by trim strips 70 between a pair of ribs 78, 79. Trim strip ribs 78 and 71 grip rib 49 to secure and hold the trim strips 70 to the mullion assembly.

Each mullion 20 also usually mounts a fluorescent fixture 80. Fixture 80 may be a conventional fixture which houses a bulb 82 and includes a protective lens 84. Fixture 80 may be secured to the mullion 20 in a known manner, as by spring loaded clips 86, as is shown in FIG. 2.

Figure 2A:
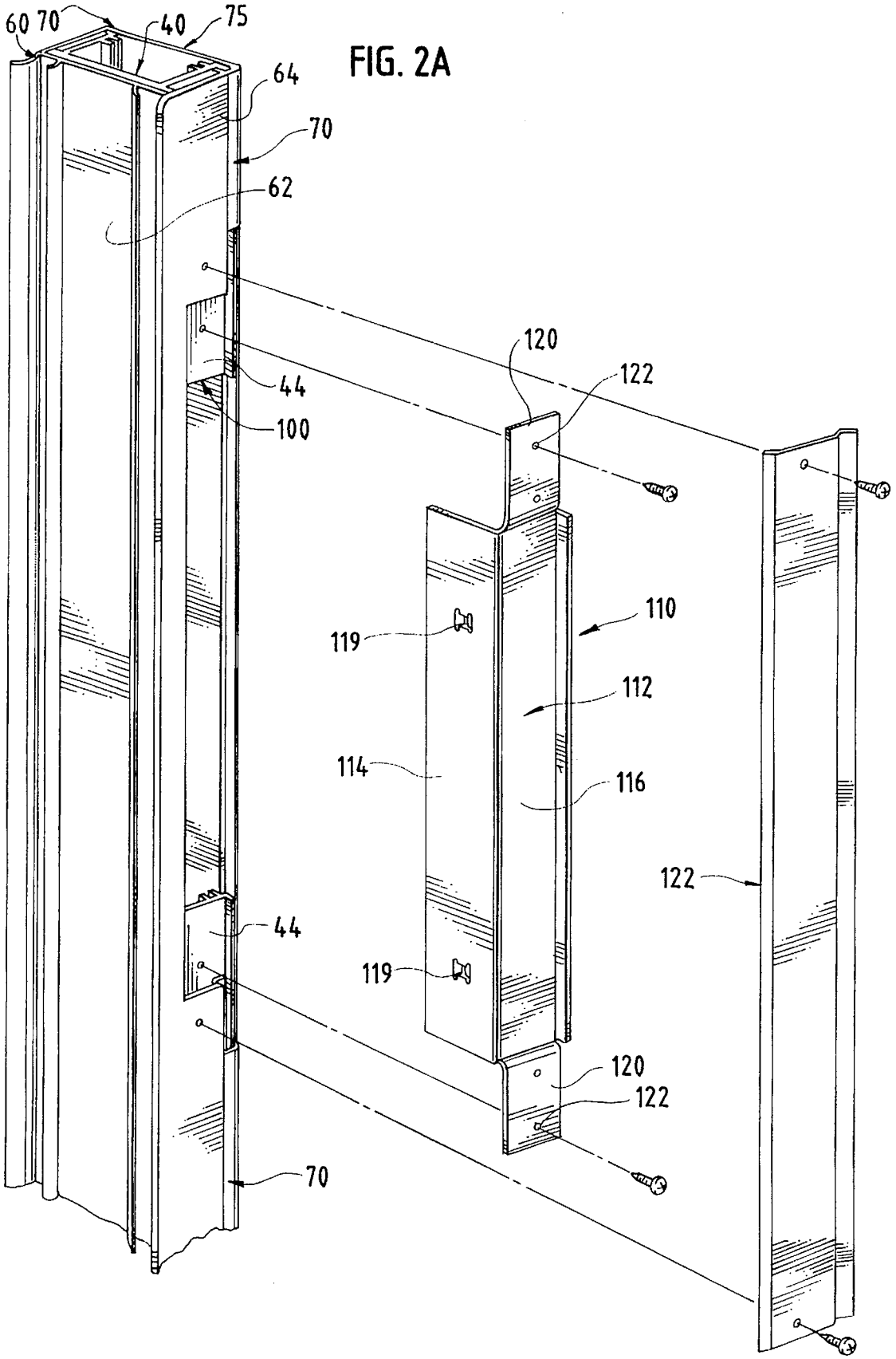
FIG. 2A is a perspective view, partially exploded, of a portion of a mullion assembly of the present invention.
Figure 4:
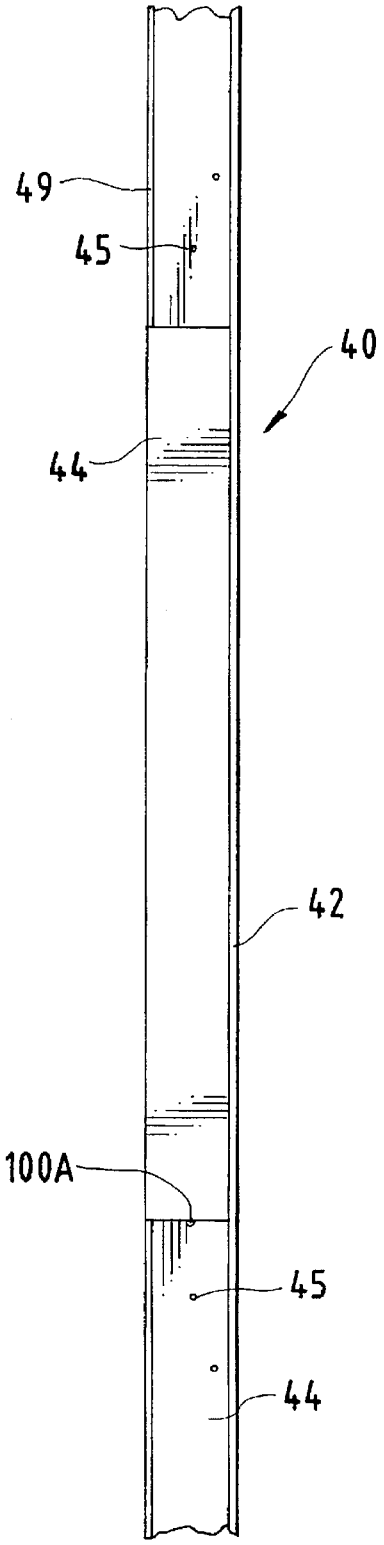
FIG. 4 a side elevational view of a first mullion member of FIG. 2 showing a side opening for receipt of a ballast assembly.
Figure 5:
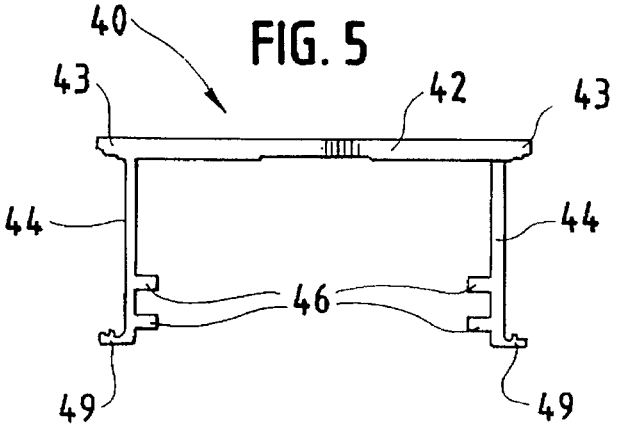
FIG. 5 is an end view of a mullion member of FIG. 4.
Figure 6:
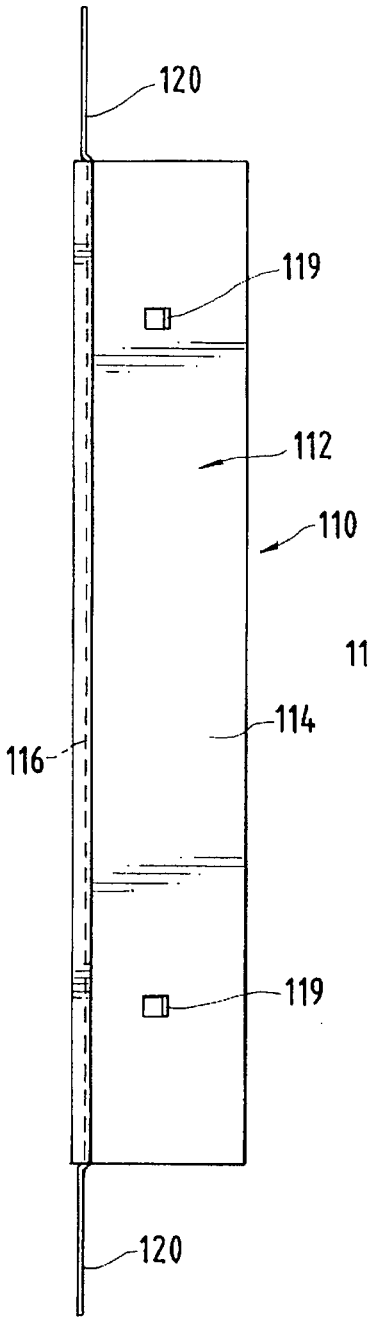
FIG. 6 is a side elevational view of a ballast drawer for securance to the mullion of FIG. 2
Figure 7:
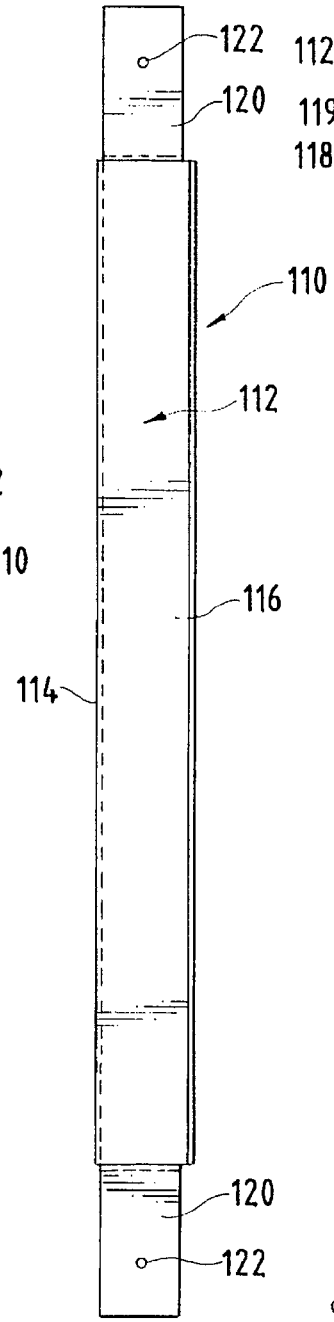
FIG. 7 is a side elevational view of the ballast drawer of FIG. 6 as rotated 90°.

In accordance with the present invention, a ballast is positioned within the mullion assembly 20. To that end the mullion assembly 20 defines an access opening 100 in one side wall thereof. The opening 100 (see FIG. 2A) comprises a cut-out in each of the mullion member 40 and sheath member 60, preferably between the ends of the member and sheath member so that leg portions of the mullion and sheath members remain above and below the cut-outs. Typical openings or cut-outs 100A and 100B are shown in FIGS. 4 and 9. The cut-out 100A typically extends forwardly from the base 42. The cut-out 100B typically extends forwardly generally from the zone of rib 65.

Figure 8:
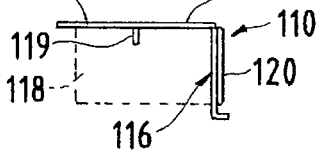
FIG. 8 is an end view of the ballast drawer of FIGS. 6 and 7.

The access opening 100 is proportioned and sized to cooperate with the removable ballast assembly 110. The ballast assembly 110 includes a ballast drawer 112. Drawer 112 comprises a support plate 114 and an associated mounting plate 116. Plates 114 and 116 are disposed at right angles to each other and together define a receptacle for the fluorescent ballast 118 (FIG. 8) which is desirably removeably secured to the support plate 114, as by a pair of lanced tabs 119 which are formed out of plate 114 and which retentively engage complementary tongues on the ballast 118.

The mounting plate 116 of the ballast drawer 112 defines means for removeably securing the ballast assembly to the mullion 20. As shown, the plate 116 includes a pair of projecting mounting ears 120, one at each end. Ears 120 define openings 122 through which threaded fasteners may pass. The threaded fasteners may threadingly engage in openings 45 in the associated leg 44, thereby to retain the ballast 118 within the mullion 20. Thereafter, a dress plate or cover 122 can be affixed, as by fasteners, over the ballast drawer and a vertical trim strip 70 can be secured to finish the assembly.

It will be apparent that a ballast and mullion assembly so constructed may be easily and quickly serviced, and while the refrigerator or freezer cabinet in which it is used continues in operation and without requiring removal of fluorescent fixtures, heater wires, doors and the like. This may be accomplished without removing doors, contents or shelving. All that is necessary is to remove the screws holding the cover 122 in place, remove the screws holding the ballast drawer in place, withdraw the ballast drawer 112, remove the electrical connectors, displace the lanced tabs 119 connecting the ballast to the support plate, reconnect a new ballast to the drawer and to the wiring harness or connector, slidingly reinsert the ballast drawer 112 and ballast back into position from the side of the mullion, fasten the screws and cover plate and the project is completed. This should take only several minutes at the most.

The assembly of the present invention also facilitates a determination of where a ballast requiring replacement is located. In those assemblies where ballasts are positioned internally of mullions and which must be accessed from the front or rear, it is virtually impossible to determine where a defective ballast is located. That is because some mullions will have ballasts, and others will not. Some mullion ballasts will typically serve several fluorescent fixtures and those fixtures will not necessarily have a ballast in the mullion on which the fixture is located. In those cases, sometimes mullion components will be removed to replace a ballast, only to find there is no ballast in that mullion. In the case of the present invention, the drawer and cover plate will signify that a ballast is present and that will indicate where the defective ballast to be removed and serviced is located.

It will be apparent to those skilled in the art that modifications may be made without departing from the spirit and scope of the invention. Accordingly, it is intended that the invention should not be limited except as may be necessary in view of the appended claims.

What is claimed is:

1. An improved refrigerated cabinet assembly having a perimetric frame and a plurality of elongated vertical mullions spaced along the length of the cabinet assembly, each mullion being secured at its top and its bottom to said perimetric frame, and a series of rectangular doors mounted on said frame for swinging movement on vertical hinge axes between open positions and closed positions, each said mullion being generally rectangular and hollow and having a front surface facing outwardly of said cabinet assembly, a back surface facing inwardly of said cabinet assembly, and a pair of side walls, said rectangular doors defining surfaces confronting the front surfaces of said mullions and being adapted to seal therewith, one of said side walls of each said mullion defining an access opening, a ballast assembly, said ballast assembly comprising a ballast drawer, a fluorescent ballast removably secured thereto, and means for removeably securing said ballast assembly to a said mullion, said ballast drawer being adapted for sliding insertion into said mullion access opening and for withdrawal therefrom, and whereby said fluorescent ballast may be quickly and easily removed for service by withdrawing said drawer from said mullion and may be quickly and easily reinstalled by slidingly inserting said ballast into said mullion from the side thereof.

2. The improved refrigerated cabinet assembly of claim 1, and wherein said ballast drawer comprises a ballast support plate and a mounting plate providing said means for removeably securing said ballast assembly to a said mullion.

3. The improved refrigerated cabinet assembly of claim 1, and wherein said mullion comprises a hollow structural member and a sheath, and said access opening comprises openings defined by each of said member and said sheath.

* * * * *